US006253875B1

(12) United States Patent
Trindade et al.

(10) Patent No.: US 6,253,875 B1
(45) Date of Patent: Jul. 3, 2001

(54) SCAFFOLD MOUNTABLE HOIST PLATFORM

(76) Inventors: Luis F. Trindade; Mary T. Trindade, both of R.R. #7, Guelph Ontario (CA), N1H 6J4

( * ) Notice: Subject to any disclaimer, the term of this patent is extended or adjusted under 35 U.S.C. 154(b) by 0 days.

(21) Appl. No.: 09/426,149

(22) Filed: Oct. 22, 1999

(51) Int. Cl.[7] ..... E04G 1/18
(52) U.S. Cl. ..... 182/141; 182/186.9; 182/186.6
(58) Field of Search ..... 182/141, 173.1, 182/186.6, 186.9; 187/213, 234, 274

(56) References Cited

U.S. PATENT DOCUMENTS

| | | | | |
|---|---|---|---|---|
| D. 265,425 | | 7/1982 | Graas . | |
| 533,404 | * | 1/1895 | Youngson | 182/141 |
| 556,961 | * | 3/1896 | Cleveland | 182/141 |
| 815,401 | * | 3/1906 | Breckon | 182/141 |
| 2,569,653 | * | 10/1951 | Boedecker | 182/186.9 X |
| 3,313,376 | | 4/1967 | Holland, Sr. . | |
| 3,672,471 | * | 6/1972 | Badding | 182/141 X |
| 3,951,236 | | 4/1976 | Schreiber et al. . | |
| 4,252,217 | * | 2/1981 | Benjamin | 187/234 |
| 4,938,310 | | 7/1990 | Larsen . | |
| 5,152,369 | | 10/1992 | Nakaoka . | |
| 5,205,379 | | 4/1993 | Pfleger . | |
| 5,908,088 | * | 6/1999 | Webster et al. | 182/141 X |

* cited by examiner

*Primary Examiner*—Daniel P. Stodola
*Assistant Examiner*—Hugh B. Thompson

(57) ABSTRACT

A scaffold mountable hoist platform for conveying of materials to different levels of a scaffold. The scaffold mountable hoist platform includes a frame having a rear frame member, a deck support member. The deck support member is orthogonally extending from the rear frame member is for supporting a deck. A plurality of rear vertical guides are positioned proximate the frame. A plurality of stanchion guide assemblies are mounted to the frame such that the stanchion guide assemblies are adapted for releasably engaging the stanchions. Each of the stanchion guide assemblies have a bearing plate and a plurality of bearings. The bearing plate has a plurality of apertures therethrough. The bearings are coupled to the bearing plate such that the bearings extend through the apertures for rollably engaging the stanchions. A lifting assembly is coupled to the frame for raising and lowering the frame along the stanchions of the scaffold.

6 Claims, 3 Drawing Sheets

FIG. 3
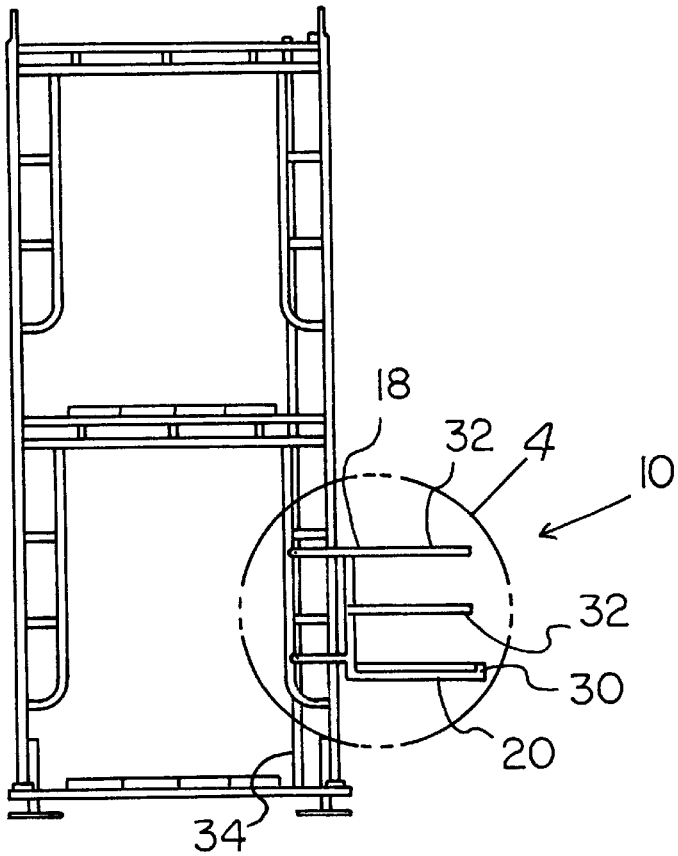
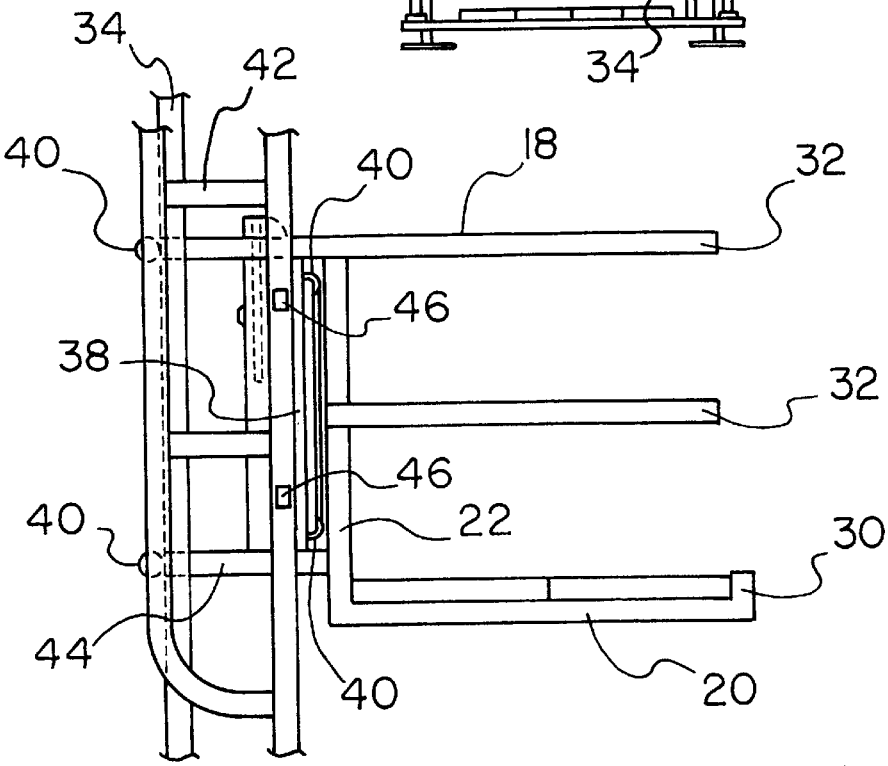
FIG. 4

SCAFFOLD MOUNTABLE HOIST PLATFORM

BACKGROUND OF THE INVENTION

1. Field of the Invention

The present invention relates to scaffold lifts and more particularly pertains to a new scaffold mountable hoist platform for conveying of materials to different levels of a scaffold.

2. Description of the Prior Art

The use of scaffold lifts is known in the prior art. More specifically, scaffold lifts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,205,379; U.S. Pat. No. 3,951,236; U.S. Pat. No. 5,152,369; U.S. Pat. No. 3,313,376; U.S. Pat. No. 4,938,310; and U.S. Pat. No. Des. 265,425.

In these respects, the scaffold mountable hoist platform according to the present invention substantially departs from the conventional concepts and designs of the prior art, and in so doing provides an apparatus primarily developed for the purpose of conveying of materials to different levels of a scaffold.

SUMMARY OF THE INVENTION

In view of the foregoing disadvantages inherent in the known types of scaffold lifts now present in the prior art, the present invention provides a new scaffold mountable hoist platform construction wherein the same can be utilized for conveying of materials to different levels of a scaffold.

The general purpose of the present invention, which will be described subsequently in greater detail, is to provide a new scaffold mountable hoist platform apparatus and method which has many of the advantages of the scaffold lifts mentioned heretofore and many novel features that result in a new scaffold mountable hoist platform which is not anticipated, rendered obvious, suggested, or even implied by any of the prior art scaffold lifts, either alone or in any combination thereof.

To attain this, the present invention generally comprises a frame having a rear frame member, a deck support member. The deck support member is orthogonally extending from the rear frame member is for supporting a deck. A plurality of rear vertical guides are positioned proximate the frame. A plurality of stanchion guide assemblies are mounted to the frame such that the stanchion guide assemblies are adapted for releasably engaging the stanchions. Each of the stanchion guide assemblies have a bearing plate and a plurality of bearings. The bearing plate has a plurality of apertures therethrough. The bearings are coupled to the bearing plate such that the bearings extend through the apertures for rollably engaging the stanchions. A lifting means is coupled to the frame for raising and lowering the frame along the stanchions of the scaffold.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new scaffold mountable hoist platform apparatus and method which has many of the advantages of the scaffold lifts mentioned heretofore and many novel features that result in a new scaffold mountable hoist platform which is not anticipated, rendered obvious, suggested, or even implied by any of the prior art scaffold lifts, either alone or in any combination thereof.

It is another object of the present invention to provide a new scaffold mountable hoist platform which may be easily and efficiently manufactured and marketed.

It is a further object of the present invention to provide a new scaffold mountable hoist platform which is of a durable and reliable construction.

An even further object of the present invention is to provide a new scaffold mountable hoist platform which is susceptible of a low cost of manufacture with regard to both materials and labor, and which accordingly is then susceptible of low prices of sale to the consuming public, thereby making such scaffold mountable hoist platform economically available to the buying public.

Still yet another object of the present invention is to provide a new scaffold mountable hoist platform which provides in the apparatuses and methods of the prior art some of the advantages thereof, while simultaneously overcoming some of the disadvantages normally associated therewith.

Still another object of the present invention is to provide a new scaffold mountable hoist platform for conveying of materials to different levels of a scaffold.

Still yet another object of the present invention is to provide a new scaffold mountable hoist platform that provides safe means of reducing the amount of work required of a person to convey the materials up the scaffold.

Even still another object of the present invention is to provide a new scaffold mountable hoist platform that reduces the amount of work time lost in transporting the materials up the scaffold.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a left side elevational view of the present invention.

FIG. 4 is an enlarged view of the area designated as 4 in FIG. 3 of the present invention.

DESCRIPTION OF THE PREFERRED EMBODIMENT

Figure 1:
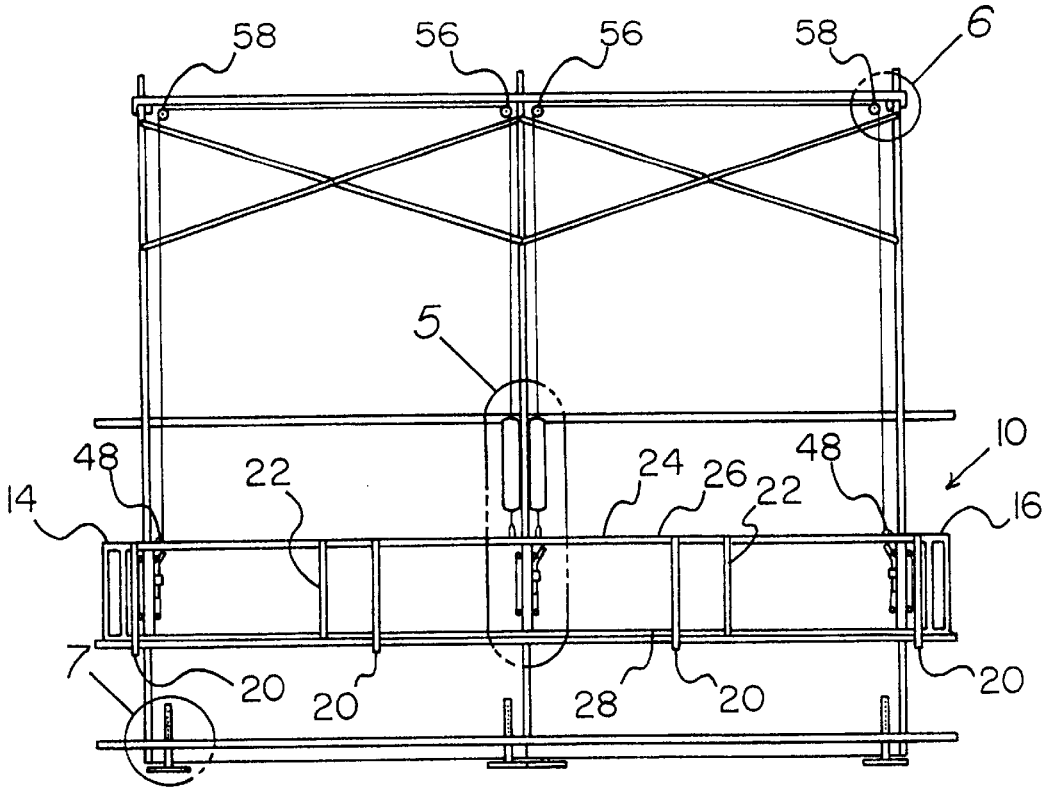
FIG. 1 is a front elevational view of a new scaffold mountable hoist platform according to the present invention.
Figure 2:
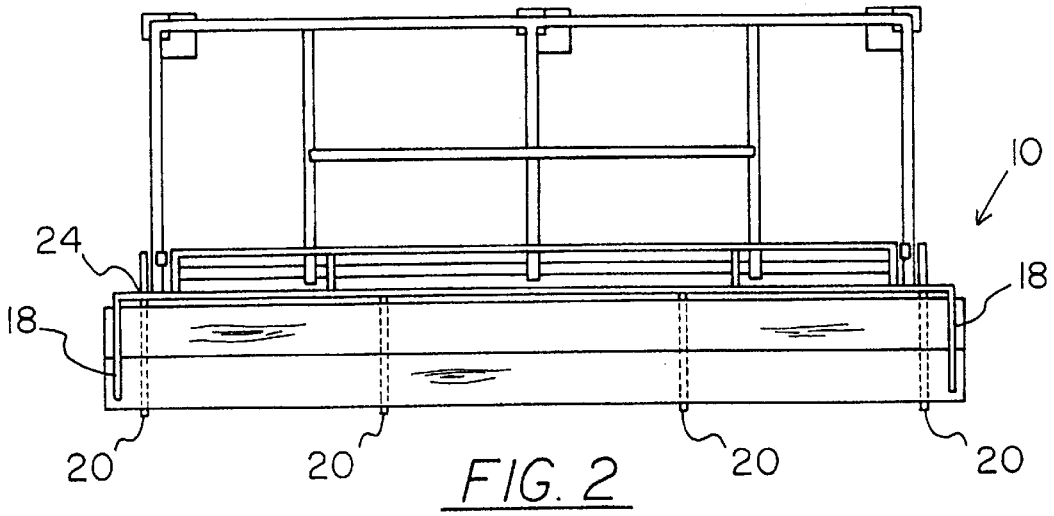
FIG. 2 is a top plan view of the present invention.
Figure 5:
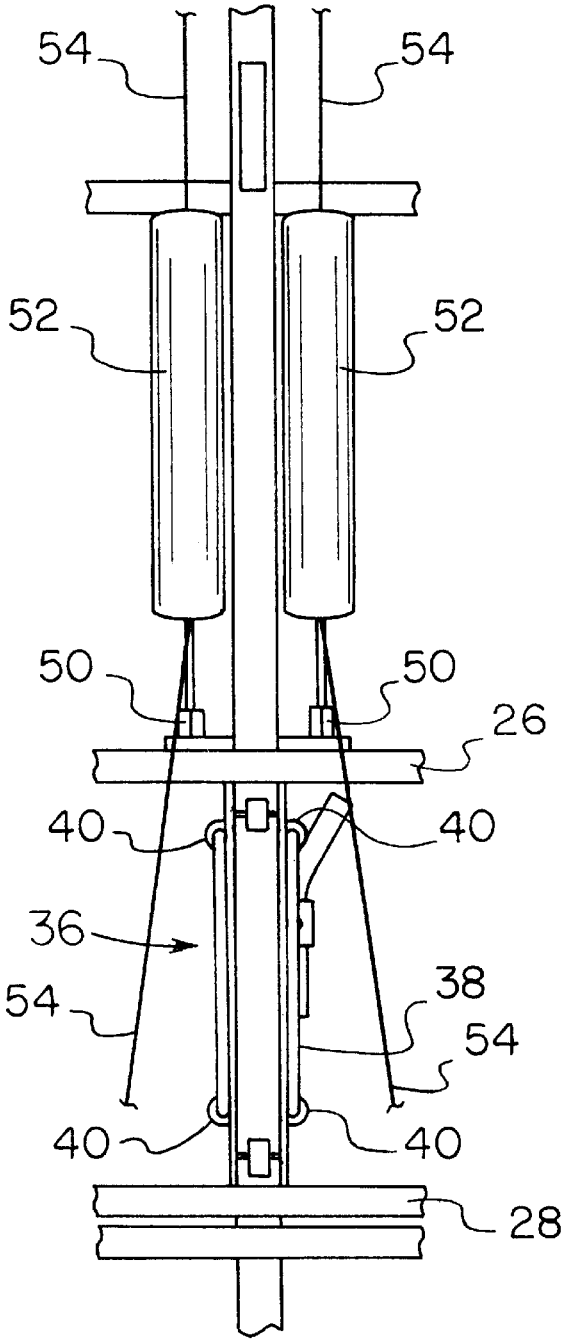
FIG. 5 is an enlarged view of the area designated as 5 in FIG. 1 of the present invention.
Figure 6:
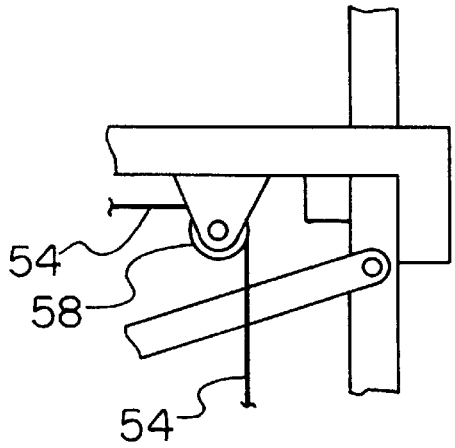
FIG. 6 is an enlarged view of the area designated as 6 in FIG. 1 of the present invention.
Figure 7:
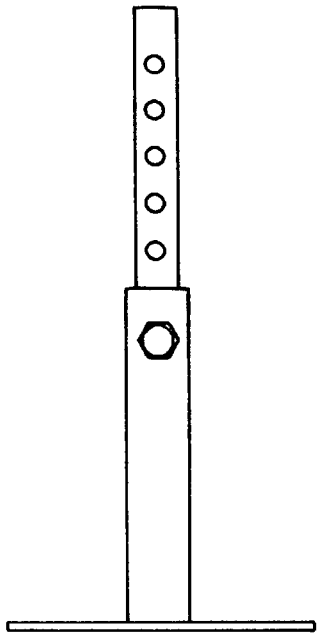
FIG. 7 is an enlarged view of the area designated as 7 in FIG. 1 of the present invention.

With reference now to the drawings, and in particular to FIGS. 1 through 7 thereof, a new scaffold mountable hoist platform embodying the principles and concepts of the present invention and generally designated by the reference numeral 10 will be described.

As best illustrated in FIGS. 1 through 7, the scaffold mountable hoist platform 10 generally comprises a frame 12 having a first end 14, a second end 16, pair of end portions 18, a plurality of decking supports 20, a plurality of vertical supports 22 and a plurality of horizontal frame members 24. The plurality horizontal frame members comprise at least a top frame member 26 and a bottom frame member 28. The frame members are aligned in a vertically planar relationship. The plurality of the decking supports are orthogonally extending forward from the bottom frame member. Each of the decking supports has a lip 30 formed on a free end thereof. The decking supports are adapted for supporting the decking. The vertical supports are coupled to the horizontal frame members such that the vertical supports are equidistantly spaced across the horizontal frame members. The end portions have one of the vertical supports are coupled to the horizontal members and a plurality of horizontal end guards 32 orthogonally extending forward from the vertical support of the end portion. The first end having one of the end portions coupled thereto. The second end having the other of the end portion coupled thereto.

Also included, a plurality of rear vertical guides 34 are coupled to the scaffold proximate the front stanchions. A plurality of stanchion guide assemblies 36 are releasably coupled between the top frame member and the bottom frame member such that the stanchion guide assemblies are adapted for engaging the stanchions of the scaffold. Each of the stanchion guides has a bearing plate 38, plurality of bearings 40, an upper frame extension 42 and a lower frame extension 44. The bearing plate has a U-shaped configuration. A pair of apertures 46 are formed through each side of the bearing plate. The bearings are coupled to an exterior surface of the bearing plate such that the bearings extend through the apertures for rollably engaging the stanchions of the scaffold. The upper horizontal frame extension is coupled to the top frame member such that the upper frame extension is orthogonally extending backwards from the top frame member. One of the plurality of bearings is coupled to a free end of the upper frame extension such that the bearing coupled to the upper frame extension are for rollably engaging the rear vertical guides. The lower horizontal frame extension is coupled to the bottom frame member such that the lower frame extension is orthogonally extending backwards from the bottom frame member. One of the plurality of bearings is coupled to a free end of the lower frame extension such that the bearing coupled to the lower frame extension is for rollably engaging the rear vertical guides.

A pair of outer lifting rings 48 and a pair of inner lifting rings 50 are coupled to the top frame member. Each of the outer lifting rings are positioned proximate the outer front stanchions. The inner lifting rings are positioned proximate the center front stanchion.

Next provided, a pair of lifting means are for lifting the frame to a desired height. Each lifting means comprises a hoist 52, a cable 54, a first pulley 56 and a second pulley 58. The hoist is releasably coupled to one of the inner lifting rings. the first pulley is coupled to the top platform brace proximate the center front stanchion. The second pulley is coupled to the top platform brace proximate one of the outer front stanchions. The cable is releasably coupled to one of the outer lifting rings. A medial portion of the cable is for operably engaging the first pulley, the second pulley and the hoist.

In use, a scaffold is erected in a manner compliant with manufactures instructions. The rear vertical guides and pulleys are attached, by bolting or welding, to the scaffold. The frame with the attached stanchion guide assemblies is aligned with scaffold such that the stanchion guide assemblies are aligned with the stanchions of the scaffold and the rear vertical guides. The hoist is then attached to the frame and the cable ran through the pulley and attached to the frame. The hoist is then actuated and the frame rises or lowers depending on the actuation of the hoist. A safety mechanism is attached to the stanchion guide assemblies to provide a stopping means in case the hoist or cable should fail.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A scaffold mountable hoist platform for the transportation of materials and personnel up and down a scaffold, the scaffold having a plurality of stanchions and a top platform brace, the hoist platform comprising:

a frame having a rear frame member, a deck support member, said deck support member being orthogonally extending from said rear frame member being for supporting a deck;

a plurality of rear vertical guides being positioned proximate said frame;

a plurality of stanchion guide assemblies being mounted to said frame such that said stanchion guide assemblies being adapted for releasably engaging the stanchions, each of said stanchion guide assemblies having a bearing plate and a plurality of bearings, said bearing plate having a plurality of apertures therethrough, said bearings being coupled to said bearing plate such that said bearings being extended through said apertures for rollably engaging the stanchions;

a lifting means being coupled to said frame for raising and lowering said frame along the stanchions of the scaffold; and wherein each of said stanchion guide assemblies comprises a frame extension, said frame extension having a bearing mounted thereto for rollably engaging one of said rear vertical guides.

2. The hoist platform as set forth in claim 1 wherein said rear frame member comprises a top frame member and a bottom frame member.

3. The hoist platform as set forth in claim 2 wherein said rear frame further comprises an intermediate horizontal frame member positioned proximate said bottom frame member for facilitating the alignment of the materials on said frame.

4. The hoist platform as set forth in claim 1 wherein said bearing plate of said stanchion guide assemblies is U-shaped.

5. The hoist platform as set forth in claim 1 wherein said lifting means comprises a hoist, a cable and a plurality of pulleys, said pulleys are adapted for coupling to the scaffold, said hoist is coupled to said frame, said cable has a first end coupled to said frame, said cable has an intermediate portion operably engaging said pulleys and said hoist.

6. A scaffold mountable hoist platform for mounting to a scaffold having a center front stanchion, a pair outer front stanchions, three rear stanchions, a top platform brace, decking and a base, the hoist platform comprising:

a frame having a first end, a second end, pair of end portions, a plurality of decking supports, a plurality of vertical supports and a plurality of horizontal frame members, said plurality horizontal frame members comprising at least a top frame member and a bottom frame member, said frame members being aligned in a vertically planar relationship, said plurality of said decking supports being orthogonally extending forward from the bottom frame member, each of said decking supports having a lip formed on a free end thereof, said decking supports being adapted for supporting the decking, said vertical supports being coupled to said horizontal frame members such that said vertical supports are equidistantly spaced across said horizontal frame members, each of said end portions having one of said vertical supports being coupled to said horizontal members and a plurality of horizontal end guards orthogonally extending forward from said vertical support of said end portion, said first end having one of said end portions coupled thereto, said second end having the other of said end portion coupled thereto;

a plurality of rear vertical guides being positioned proximate the front stanchions;

a plurality of stanchion guide assemblies being releasably coupled between said top frame member and said bottom frame member such that said stanchion guide assemblies being adapted for engaging the stanchions of the scaffold, each of said stanchion guides having a bearing plate, plurality of bearings, an upper frame extension and a lower frame extension , said bearing plate having a U-shaped configuration, a pair of apertures are formed through each side of said bearing plate, said bearings being coupled to an exterior surface of said bearing plate such that said bearings being extending through said apertures for rollably engaging the stanchions of said scaffold, said upper horizontal frame extension being coupled to said top frame member such that said upper frame extension being orthogonally extending backwards from said top frame member, one of said plurality of bearings being coupled to a free end of said upper frame extension such that said bearing coupled to said upper frame extension being for rollably engaging said rear vertical guides, said lower horizontal frame extension being coupled to said bottom frame member such that said lower frame extension being orthogonally extending backwards from said bottom frame member, one of said plurality of bearings being coupled to a free end of said lower frame extension such that said bearing coupled to said lower frame extension being for rollably engaging said rear vertical guides;

a pair of outer lifting rings and a pair of inner lifting rings being coupled to said top frame member, each of said outer lifting rings being positioned proximate the outer front stanchions, said inner lifting rings being positioned proximate the center front stanchion; and a pair of lifting means being for lifting said frame to a desired height, each lifting means comprising a hoist, a cable, a first pulley and a second pulley, said hoist being releasably coupled to one of said inner lifting rings, said first pulley being coupled to the top platform brace proximate the center front stanchion, said second pulley being coupled to the top platform brace proximate one of the outer front stanchions, said cable being releasably coupled to one of said outer lifting rings, a medial portion of said cable being for operably engaging said first pulley, said second pulley and said hoist.

* * * * *